US006145481A

United States Patent [19]

Bock et al.

[11] Patent Number: 6,145,481

[45] Date of Patent: Nov. 14, 2000

[54] COOLING RING FOR A CYLINDER LINER IN AN INTERNAL COMBUSTION ENGINE

[75] Inventors: Allyn P. Bock, West Lafayette; Brian K. Kruse, Lafayette, both of Ind.

[73] Assignee: Caterpillar Inc., Peoria, Ill.

[21] Appl. No.: 09/349,276

[22] Filed: Jul. 7, 1999

[51] Int. Cl.[7] ..... F02F 1/14; F01P 3/02

[52] U.S. Cl. ..... 123/41.79; 123/41.84

[58] Field of Search ..... 123/41.83, 41.84, 123/41.79, 41.8

[56] References Cited

U.S. PATENT DOCUMENTS

| | | | |
|---|---|---|---|
| 1,968,449 | 7/1934 | Hefti | 123/173 |
| 2,120,004 | 6/1938 | Schwaiger | 123/173 |
| 2,411,924 | 12/1946 | Kratzer | 123/173 |
| 3,315,573 | 4/1967 | De Castelet | 92/171 |
| 3,653,369 | 4/1972 | Fangman et al. | 123/193 |
| 3,672,263 | 6/1972 | Mirjanic | 92/144 |
| 3,800,751 | 4/1974 | Glassey et al. | 123/41.84 |
| 3,853,099 | 12/1974 | Feather et al. | 123/41.82 |
| 3,882,842 | 5/1975 | Bailey et al. | 123/193 C |
| 4,796,572 | 1/1989 | Heydrich | 123/41.42 |
| 5,150,668 | 9/1992 | Bock | 123/41.8 |
| 5,575,251 | 11/1996 | Bock | 123/193.3 |
| 5,596,954 | 1/1997 | Kennedy | 123/41.84 |

FOREIGN PATENT DOCUMENTS 969 880 7/1958 Germany .

*Primary Examiner*—Willis R. Wolfe
*Assistant Examiner*—Katrina B. Harris
*Attorney, Agent, or Firm*—Taylor & Aust, P.C.

[57] ABSTRACT

An internal combustion engine includes a cylinder block with a cylinder bore. A cylinder liner within the cylinder bore has a distal end with an outside diameter. A cooling ring has a first inside diameter, a larger second inside diameter and a plurality of radial coolant passages. The first inside diameter is positioned closely adjacent to the outside diameter at the distal end of the cylinder liner. The second inside diameter is radially spaced apart from and defines an annular coolant channel with the outside diameter of the cylinder liner. The radial coolant passages are in fluid communication with the annular coolant channel.

13 Claims, 2 Drawing Sheets

COOLING RING FOR A CYLINDER LINER IN AN INTERNAL COMBUSTION ENGINE

TECHNICAL FIELD

The present invention relates to internal combustion engines, and, more particularly, to a cooling ring for a cylinder liner in an internal combustion engine.

BACKGROUND ART

Internal combustion engines, such as multi-cylinder diesel or gasoline engines, typically include a cylinder block defining a plurality of cylinder bores which reciprocally carry respective pistons therein. Each cylinder bore may include a cylinder liner in which the piston actually reciprocates. Cylinder liners allow a cylinder block with a particular cylinder bore configuration and size to be used with multiple different diameter pistons by simply changing the cylinder liners for a particularly configured engine. Moreover, the cylinder liners may be removed and replaced if worn through use over time. Additionally, an internal combustion engine for use as a diesel engine may require a cylinder liner which is configured differently from an internal combustion engine used as a gasoline engine.

It is known to provide an internal combustion engine with a coolant sleeve which is positioned radially around a cylinder liner. Liquid coolant such as antifreeze flows through an annular channel defined between the cylinder liner and cylinder bore, around and/or through the coolant sleeve, and then to further passageways or channels in the cylinder block and/or cylinder head. Examples of coolant sleeves used with internal combustion engines are disclosed in U.S. Pat. Nos. 5,150,668 (Bock) and 3,481,316 (Olson et al.), each of which are assigned to the assignee of the present invention.

Although effective for certain configured engines, coolant sleeves as described above may not be effective for use with other internal combustion engines, dependent upon the specific configuration of the internal combustion engine.

The present invention is directed to overcoming one or more of the problems as set forth above.

DISCLOSURE OF THE INVENTION

In one aspect of the invention, an internal combustion engine includes a cylinder block with a cylinder bore. A cylinder liner within the cylinder bore has a distal end with an outside diameter. A cooling ring has a first inside diameter, a larger second inside diameter and a plurality of radial coolant passages. The first inside diameter is positioned closely adjacent to the outside diameter at the distal end of the cylinder liner. The second inside diameter is radially spaced apart from and defines an annular coolant channel with the outside diameter of the cylinder liner. The radial coolant passages are in fluid communication with the annular coolant channel.

In another aspect of the invention, a cooling ring is positionable between a cylinder bore and a cylinder liner in an internal combustion engine. The cooling ring includes a ring-shaped body having a first inside diameter, a larger second inside diameter, an outside diameter and a plurality of radial coolant passages. Each of the radial coolant passages extend from the second inside diameter to the outside diameter and are positioned adjacent to the first inside diameter.

BEST MODE FOR CARRYING OUT THE INVENTION

Figure 1:
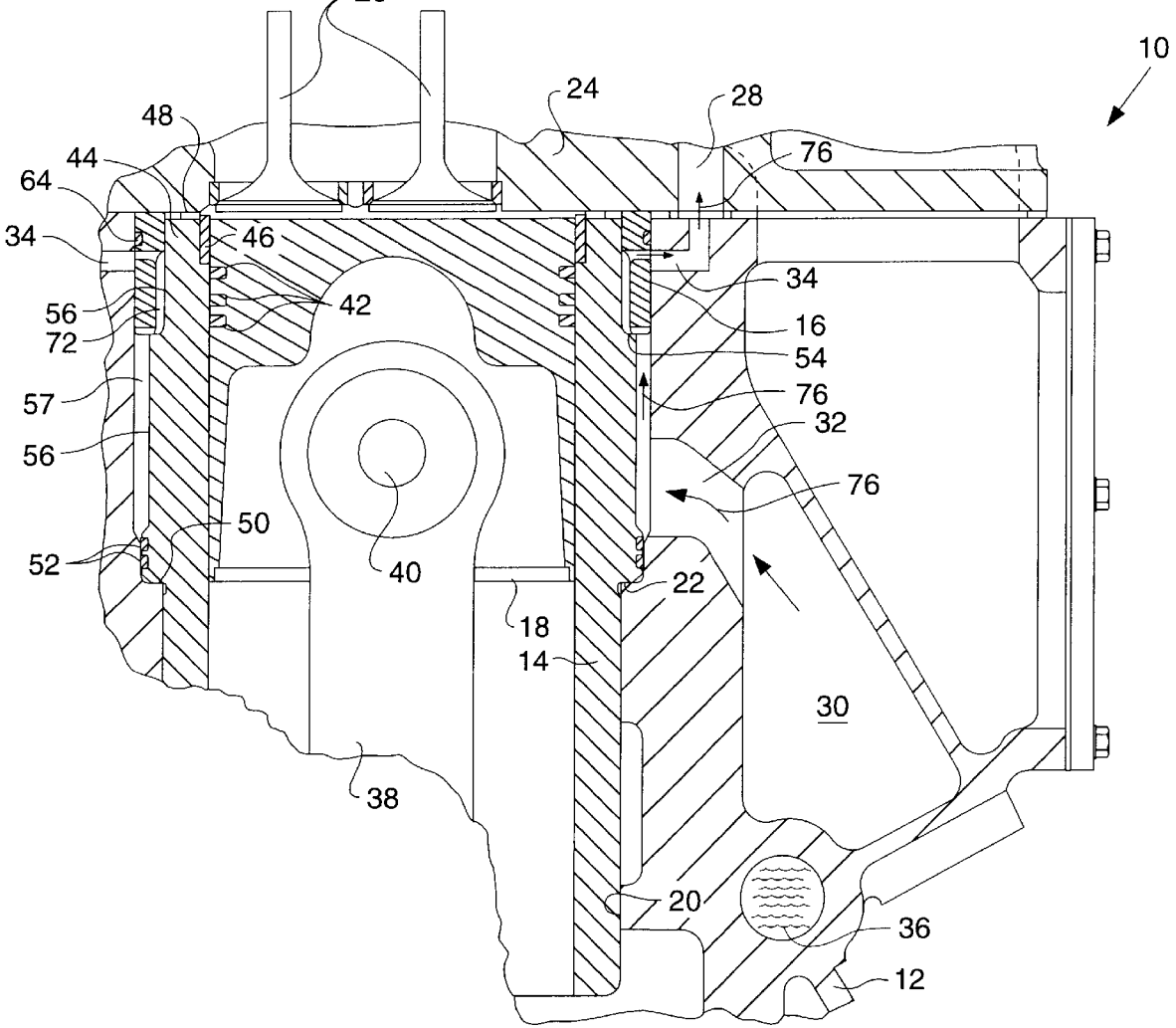
FIG. 1 is a fragmentary, sectional view of a portion of an embodiment of an internal combustion engine of the present invention.

Referring now to the drawings, and more particularly to FIG. 1, there is shown an embodiment of an internal combustion engine 10 of the present invention which generally includes a cylinder block 12, cylinder liner 14, cooling ring 16 and piston 18.

Cylinder block 12 includes a cylinder bore 20 in which cylinder liner 14 is disposed. Cylinder bore 20 includes a shoulder 22 against which cylinder liner 14 seats. A cylinder head 24 which is attached to cylinder block 12 covers cylinder bore 20 and carries a plurality of valves 26. Cylinder head 24 includes a channel 28 (shown schematically in FIG. 1) for receiving a flow of liquid coolant such as antifreeze and thereby cooling cylinder head 24, as will be described hereinafter.

Cylinder block 12 also includes one or more appropriately configured channels 30 through which liquid coolant is transported. One or more branch channels 32 and 34 allow a flow of liquid coolant along cylinder liner 14 and between channel 30 in cylinder block 12 and channel 28 in cylinder head 24, as will be described in more detail hereinafter. Channels 28 and 30, and branch channels 32 and 34 may have any suitable configuration dependent upon the specific configuration of internal combustion engine 10, and are shown schematically by phantom lines in FIG. 1 for simplicity of illustration.

Cylinder block 12 also includes one or more pressurized lubricant conduits, such as outboard oil gallery 36, which provide oil under pressure for lubrication of moving parts within internal combustion engine 10. For example, internal combustion engine 10 may be provided with porting (not shown) fluidly connected with oil gallery 36 and used to lubricate and cool piston 18 within cylinder liner 14.

Piston 18 is reciprocally disposed within cylinder liner 14, and is pivotally connected with a connecting rod 38 by a piston pin 40. An end of connecting rod 38 opposite from piston pin 40 is pivotally connected with a crank pin of a rotating crank shaft in known matter. Piston 18 reciprocates between a top dead center TDC and a bottom dead center BDC position within cylinder liner 14 during rotational movement of the crankshaft. Piston 18 may include a plurality of piston ring grooves with piston rings 42 disposed therein which allow a substantially fluid tight reciprocating movement of piston 18 within cylinder liner 14.

Cylinder liner 14 includes a distal end 44 which is disposed adjacent to cylinder head 24. Scraper ring 46 and sealing ring 48 are each substantially annular-shaped. Scraper ring 46 has a cross section which extends substantially parallel to a longitudinal axis of piston 18. Contrarily, sealing ring 48 has a cross section which extends substantially orthogonal to a longitudinal axis of piston 18.

Cylinder liner 14 includes a shoulder 50 which abuts against shoulder 22 of cylinder block 12. Shoulder 50 is disposed a predetermined axial distance away from distal end 44 of cylinder liner 14. In the embodiment shown, shoulder 50 is disposed at approximately the same distance as the bottom of piston 18 when piston 18 is at a TDC position (as shown in FIG. 1). Cylinder liner 14 includes one or more annular grooves with corresponding annular seals 52 therein which seal between cylinder liner 14 and cylinder block 12.

Cylinder liner 14 also includes a second annular shoulder 54 formed on the radial exterior periphery thereof. Shoulder 54 is positioned away from distal end 44 a distance corresponding approximately to the height of cooling ring 16. Cooling ring 16 thus lies closely adjacent to each of shoulder 54 and cylinder head 24.

Cylinder liner 14 also includes an outside diameter 56 disposed between block shoulder 22 and liner shoulder 50 which is smaller than the inside diameter of cylinder bore 20. Cylinder liner 14 and cylinder bore 20 therefore define an annular coolant channel 57 therebetween through which liquid coolant can flow.

Figure 2:
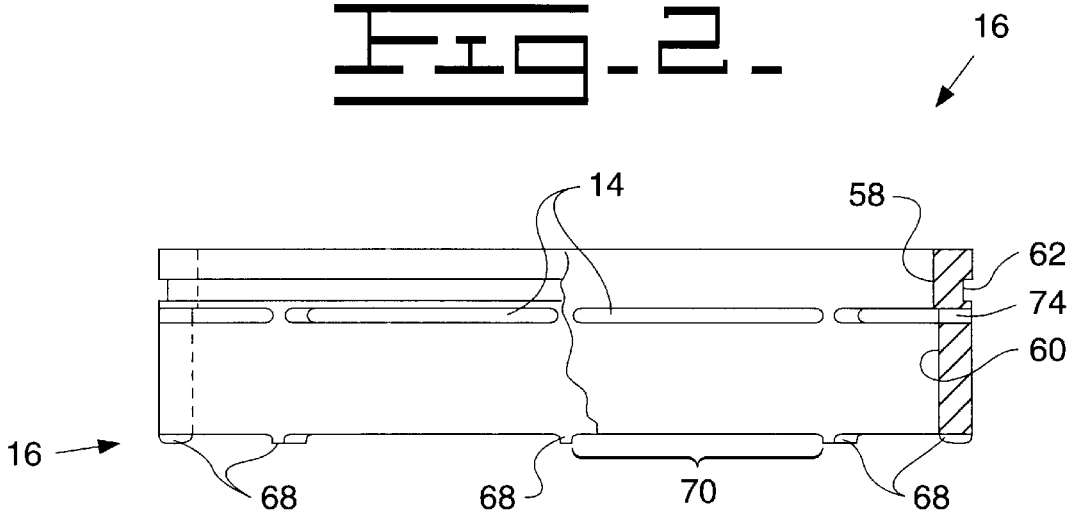
FIG. 2 is a fragmentary, side sectional view of the cooling ring shown in FIG. 1.
Figure 3:
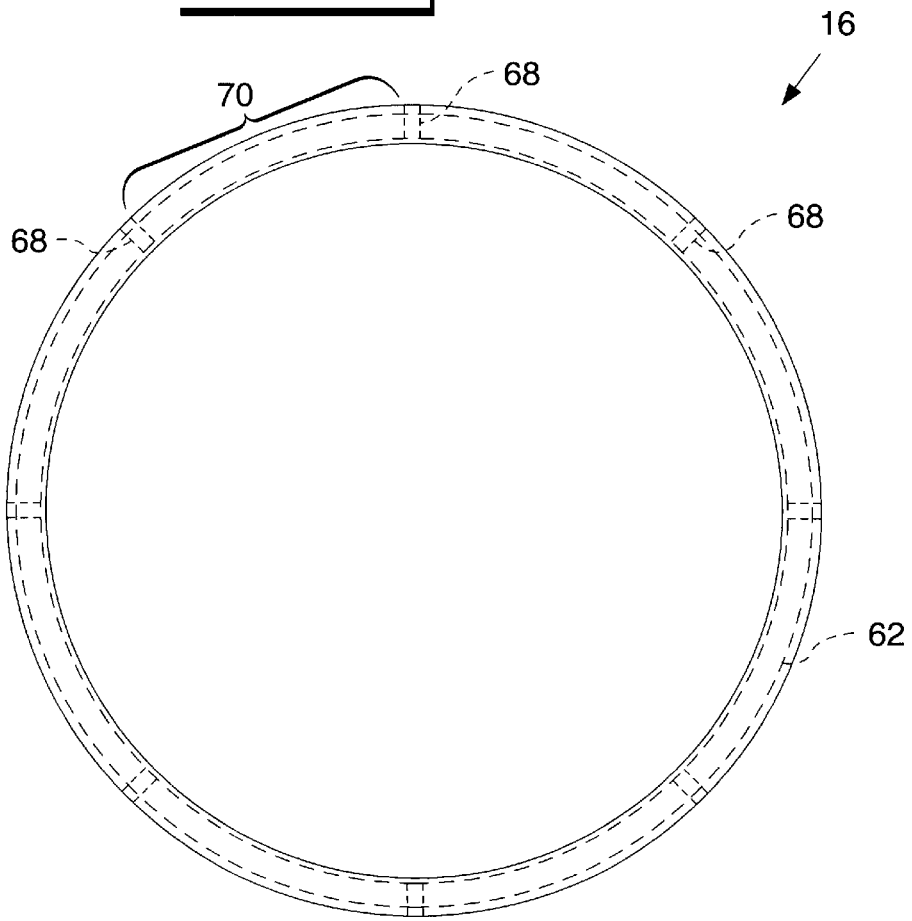
FIG. 3 is a top view of the cooling ring shown in FIGS. 1 and 2.

Cooling ring 16 (FIGS. 1–3) is disposed between cylinder liner 14 and cylinder bore 20 of cylinder block 12. Cooling ring 16 generally is sandwiched between shoulder 54, cylinder bore 20 and cylinder head 24, and is configured to allow fluid flow between annular channel 57 and branch channel 34.

Cooling ring 16 includes a first inside diameter 58 which is positioned closely adjacent to an outside diameter of cylinder liner 14 at distal end 44. In the embodiment shown, first inside diameter 58 directly engages the outside diameter of cylinder liner 14 at distal end 44. Cooling ring 16 includes an outside diameter generally opposite from first inside diameter 58 with an annular groove 62 therein which receives an annular seal 64 for sealing between cooling ring 16 and cylinder bore 20.

Cooling ring 16 includes an end 66 which is positioned adjacent to shoulder 54 of cylinder liner 14. End 66 of cooling ring 16 includes a plurality of axially extending projections 68 which are angularly spaced about end 66. Projections 68 abut against shoulder 54 of cylinder liner 14 and define a plurality of flow passages 70 therebetween through which liquid coolant may flow.

Second inside diameter 60 of cooling ring 16 is positioned between first inside diameter 58 and end 66. Second inside diameter 60 is larger than first inside diameter 58, and thereby defines an annular coolant channel 72 between cylinder liner 14 and second inside diameter 60. A plurality of radial coolant passages 74 are formed in cooling ring 16 adjacent to each of first inside diameter 58 and second inside diameter 60. Radial coolant passages 74 fluidly interconnect annular coolant channel 72 with branch channels 34 in cylinder block 12. In the embodiment shown, radial coolant passages 74 are in the form of slots disposed in an end-to-end manner around cooling ring 16.

INDUSTRIAL APPLICABILITY

During use, liquid coolant such as antifreeze is transported through channel 30 within cylinder block 12. The liquid coolant flows through one or more appropriately configured branch channels 32 to an end of annular channel 57 disposed away from cooling ring 16. The liquid coolant travels in the annular channel 57 around cylinder liner 14 in a direction generally toward cooling ring 16. The liquid coolant then flows through the flow passages 70 between projection 68 and into the annular coolant channel 72 between second inside diameter 60 and cylinder liner 14. The liquid coolant then flows in a radial direction through radial coolant passages 74 and into branch channels 34 which connect with other appropriate flow channels, such as a channel 28 in cylinder head 24. The general flow directions of the liquid coolant adjacent to cylinder liner 14 and around cooling ring 16 are indicated generally by arrows 76. Seals 52 and 64 on cylinder liner 14 and cooling ring 16, respectively, confine the liquid coolant to the illustrated flow path.

The configuration of cylinder liner 14, cylinder block 12 and cooling ring 16 coact to provide effective cooling of cylinder liner 14 within internal combustion engine 10. The dimensions and shapes of the various coolant flow channels 57, 70, 72 and 34 can be shaped and/or sized to provide a flow of liquid coolant at various points adjacent to cylinder liner 14 with a predetermined flow velocity. Since the flow velocity of the liquid coolant is directly related to the convection coefficient of heat transfer, the shape and/or size of the various channels and thus the flow velocity of the liquid coolant can be tailored dependent upon the specific configuration and use of internal combustion engine 10. For example, an internal combustion engine 10 configured as a diesel engine may require different flow and heat transfer characteristics then an internal combustion engine 10 configured as a gasoline engine.

Other aspects, objects and advantages of this invention can be obtained from a study of the drawings, the disclosure and the appended claims.

What is claimed is:

1. An internal combustion engine, comprising:

a cylinder block having a cylinder bore;

a cylinder liner within said cylinder bore, said cylinder liner having a distal end with an outside diameter; and a cooling ring having a first inside diameter, a larger second inside diameter and a plurality of radial coolant passages, said first inside diameter positioned closely adjacent said outside diameter at said distal end of said cylinder liner, said second inside diameter being radially spaced apart from and defining an annular coolant channel with said outside diameter of said cylinder liner, said radial coolant passages being in fluid communication with said annular coolant channel.

2. The internal combustion engine of claim 1, wherein each of said radial coolant passages extend from said second inside diameter.

3. The internal combustion engine of claim 2, wherein said radial coolant passages comprise slots.

4. The internal combustion engine of claim 2, wherein each of said radial coolant passages are adjacent said first inside diameter.

5. The internal combustion engine of claim 1, wherein said cylinder liner includes a radially extending stepped shoulder and wherein said cooling ring includes a radially extending plurality of axially extending projections positioned adjacent to said shoulder.

6. The internal combustion engine of claim 1, wherein said cooling ring includes an annular groove with an annular seal therein.

7. The internal combustion engine of claim 6, wherein said cooling ring has an outside diameter including said annular groove, and wherein said seal seals between said cylinder bore and said cooling ring.

8. The internal combustion engine of claim 7, wherein said cooling ring has an end substantially coterminous with said distal end of said cylinder liner, and wherein said seal is disposed between said end of said cooling ring and said plurality of radial coolant passages.

9. A cooling ring positionable between a cylinder bore and a cylinder liner in an internal combustion engine, said cooling ring comprising:

a ring-shaped body having a first inside diameter, a larger second inside diameter, an outside diameter and a plurality of radial coolant passages, each of said radial coolant passages extending from said second inside diameter to said outside diameter and positioned adjacent to said first inside diameter.

10. The cooling ring of claim 9, wherein said radial coolant passages comprise slots.

11. The cooling ring of claim 9, wherein said cooling ring includes a plurality of axially extending projections positioned adjacent to said second inside diameter.

12. The cooling ring of claim 9, wherein said cooling ring includes an annular groove for retaining an annular seal therein.

13. The cooling ring of claim 12, wherein said outside diameter includes said annular groove.

* * * * *